US006540162B1

(12) United States Patent
Johnson et al.

(10) Patent No.: US 6,540,162 B1
(45) Date of Patent: Apr. 1, 2003

(54) METHODS AND APPARATUS FOR DECREASING COMBUSTOR EMISSIONS WITH SPRAY BAR ASSEMBLY

(75) Inventors: Arthur Wesley Johnson, Cincinnati, OH (US); Robert Andrew Wade, Dearborn, MI (US); David Louis Burrus, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/604,985

(22) Filed: Jun. 28, 2000

(51) Int. Cl.[7] ..... A62C 2/08; A62C 37/08; B05B 1/14; E21F 5/04; F23D 11/38

(52) U.S. Cl. ..... 239/548; 239/548; 239/566; 239/567; 239/553.5

(58) Field of Search ..... 239/548, 566, 239/567, 555, 553.5, 554; 60/261, 740, 749, 747, 39.826, 39.821

(56) References Cited

U.S. PATENT DOCUMENTS 4,019,320 A * 4/1977 Redinger, Jr. et al. .... 60/266 R
4,132,204 A * 1/1979 Teague ..... 123/139 AW
4,553,901 A * 11/1985 Laurello ..... 415/138
4,798,048 A * 1/1989 Clements ..... 60/261
4,887,425 A * 12/1989 Vdoviak ..... 60/261
5,297,391 A * 3/1994 Roche ..... 60/740
5,385,015 A * 1/1995 Clements et al. ..... 60/261

FOREIGN PATENT DOCUMENTS

EP 1 010 944 A2 6/2000
EP 1 010 946 A2 6/2000

* cited by examiner

*Primary Examiner*—Michael Mar
*Assistant Examiner*—Davis Hwu
(74) *Attorney, Agent, or Firm*—William Scott Andes; Armstrong Teasdale LLP

(57) ABSTRACT

A combustor for a gas turbine engine operates with high combustion efficiency, and low nitrous oxide emissions during engine operations. The combustor includes at least one trapped vortex cavity, a fuel delivery system including two fuel circuits, and a fuel spray bar assembly. A pilot fuel circuit supplies fuel to the trapped vortex cavity and a main fuel circuit supplies fuel to the combustor. The fuel spray bar assembly includes a spray bar and a heat shield. The spray bar is sized to fit within the heat shield. The heat shield includes aerodynamically-shaped upstream and downstream sides.

7 Claims, 5 Drawing Sheets

METHODS AND APPARATUS FOR DECREASING COMBUSTOR EMISSIONS WITH SPRAY BAR ASSEMBLY

BACKGROUND OF THE INVENTION

This application relates generally to combustors and, more particularly, to gas turbine combustors.

Air pollution concerns worldwide have led to stricter emissions standards both domestically and internationally. Aircraft are governed by both Environmental Protection Agency (EPA) and International Civil Aviation Organization (ICAO) standards. These standards regulate the emission of oxides of nitrogen (NOx), unburned hydrocarbons (HC), and carbon monoxide (CO) from aircraft in the vicinity of airports, where they contribute to urban photochemical smog problems. Most aircraft engines are able to meet current emission standards using combustor technologies and theories proven over the past 50 years of engine development. However, with the advent of greater environmental concern worldwide, there is no guarantee that future emissions standards will be within the capability of current combustor technologies.

In general, engine emissions fall into two classes: those formed because of high flame temperatures (NOx), and those formed because of low flame temperatures which do not allow the fuel-air reaction to proceed to completion (HC & CO). A small window exists where both pollutants are minimized. For this window to be effective, however, the reactants must be well mixed, so that burning occurs evenly across the mixture without hot spots, where NOx is produced, or cold spots, when CO and HC are produced. Hot spots are produced where the mixture of fuel and air is near a specific ratio when all fuel and air react (i.e. no unburned fuel or air is present in the products). This mixture is called stoichiometric. Cold spots can occur if either excess air is present (called lean combustion), or if excess fuel is present (called rich combustion).

Known gas turbine combustors include mixers which mix high velocity air with a fine fuel spray. These mixers usually consist of a single fuel injector located at a center of a swirler for swirling the incoming air to enhance flame stabilization and mixing. Both the fuel injector and mixer are located on a combustor dome.

In general, the fuel to air ratio in the mixer is rich. Since the overall combustor fuel-air ratio of gas turbine combustors is lean, additional air is added through discrete dilution holes prior to exiting the combustor. Poor mixing and hot spots can occur both at the dome, where the injected fuel must vaporize and mix prior to burning, and in the vicinity of the dilution holes, where air is added to the rich dome mixture.

Properly designed, rich dome combustors are very stable devices with wide flammability limits and can produce low HC and CO emissions, and acceptable NOx emissions. However, a fundamental limitation on rich dome combustors exists, since the rich dome mixture must pass through stoichiometric or maximum NOx producing regions prior to exiting the combustor. This is particularly important because as the operating pressure ratio (OPR) of modem gas turbines increases for improved cycle efficiencies and compactness, combustor inlet temperatures and pressures increase the rate of NOx production dramatically. As emission standards become more stringent and OPR's increase, it appears unlikely that traditional rich dome combustors will be able to meet the challenge.

One state-of-the-art lean dome combustor is referred to as a trapped vortex combustor because it includes a trapped vortex incorporated into a combustor liner. Such combustors include a dome inlet module and an elaborate fuel delivery system. The fuel delivery system includes a spray bar that supplies fuel to the trapped vortex cavity and to the dome inlet module. The spray bar includes a heat shield that minimizes heat transfer from the combustor to the spray bar. Because of the velocity of air flowing through the combustor, recirculation zones may form downstream from the heat shield and the fuel and air may not mix thoroughly prior to ignition. As a result of the fuel being recirculated, a flame may damage the heat shield, or fuel may penetrate into the heat shield and be auto-ignited.

BRIEF SUMMARY OF THE INVENTION

In an exemplary embodiment, a combustor for a gas turbine engine operates with high combustion efficiency and low carbon monoxide, nitrous oxide, and smoke emissions during engine power operations. The combustor includes at least one trapped vortex cavity, a fuel delivery system that includes at least two fuel circuits, and a fuel spray bar assembly that supplies fuel to the combustor. The two fuel stages include a pilot fuel circuit that supplies fuel to the trapped vortex cavity and a main fuel circuit that supplies fuel to the combustor. The fuel spray bar assembly includes a spray bar and a heat shield. The spray bar is sized to fit within the heat shield and includes a plurality of injector tips. The heat shield includes aerodynamically-shaped upstream and downstream sides and a plurality of openings in flow communication with the spray bar injection tips.

During operation, fuel is supplied to the combustor through the spray bar assembly. Combustion gases generated within the trapped vortex cavity swirl and stabilize the mixture prior to the mixture entering a combustion chamber. The heat shield improves fuel and air mixing while preventing recirculation zones from forming downstream from the heat shield. During operation, high heat transfer loads develop resulting from convection due to a velocity of heated inlet air and radiation from combustion gases generated within the combustor. The heat shield protects the spray bar assembly from heat transfer loads. Furthermore, the spray bar assembly prevents fuel from auto-igniting within the heat shield. Because the fuel and air are mixed more thoroughly, peak flame temperatures within the combustion chamber are reduced and nitrous oxide emissions generated within the combustor are also reduced. As a result, a combustor is provided which operates with a high combustion efficiency while controlling and maintaining emissions during engine operations.

DETAILED DESCRIPTION OF THE INVENTION

Figure 1:
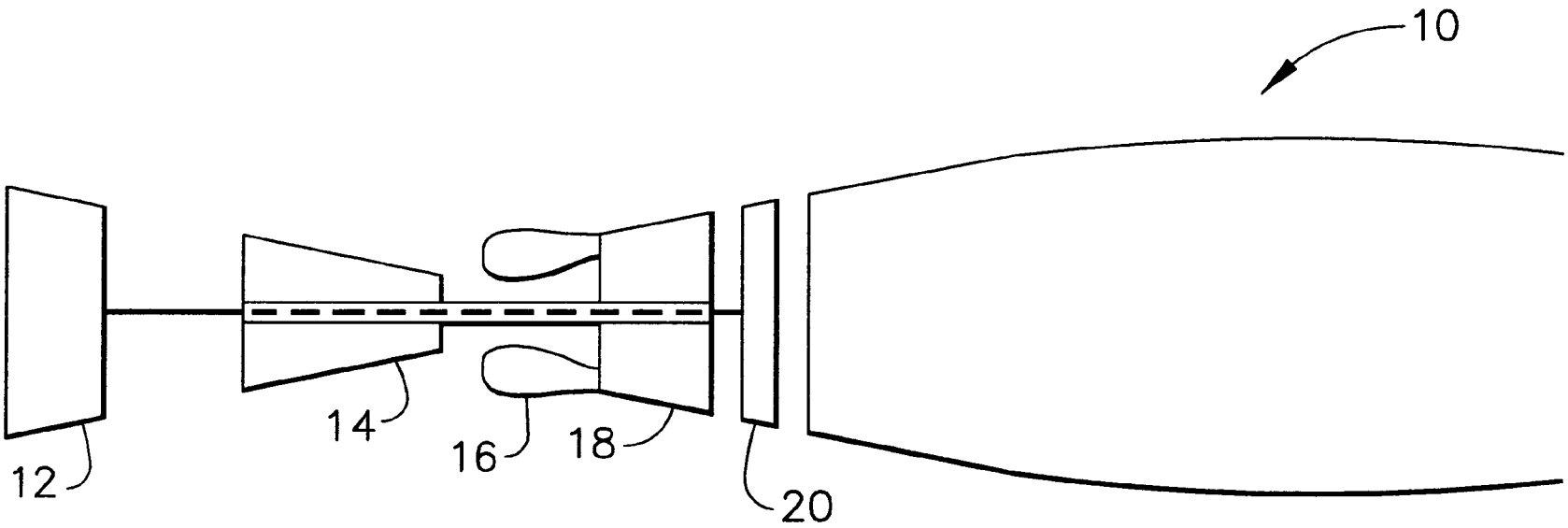
FIG. 1 is schematic illustration of a gas turbine engine including a combustor.

FIG. 1 is a schematic illustration of a gas turbine engine 10 including a low pressure compressor 12, a high pressure compressor 14, and a combustor 16. Engine 10 also includes a high pressure turbine 18 and a low pressure turbine 20.

In operation, air flows through low pressure compressor 12 and compressed air is supplied from low pressure compressor 12 to high pressure compressor 14. The highly compressed air is delivered to combustor 16. Airflow (not shown in FIG. 1) from combustor 16 drives turbines 18 and 20.

Figure 2:
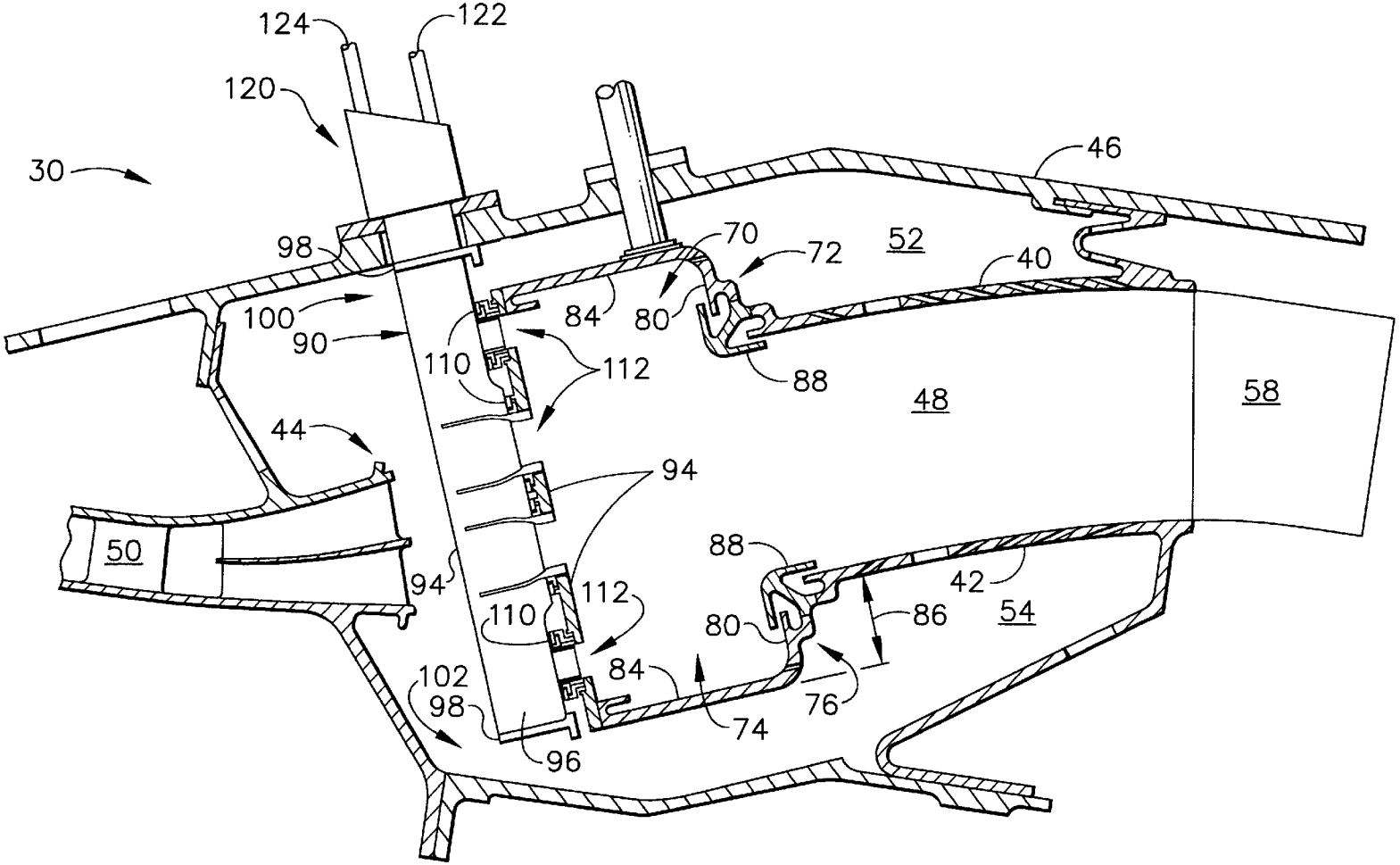
FIG. 2 is a partial cross-sectional view of a combustor used with the gas turbine engine shown in FIG. 1.

FIG. 2 is a partial cross-sectional view of a combustor 30 for use with a gas turbine engine, similar to engine 10 shown in FIG. 1. In one embodiment, the gas turbine engine is a GE F414 engine available from General Electric Company, Cincinnati, Ohio. Combustor 30 includes an annular outer liner 40, an annular inner liner 42, and a domed inlet end 44 extending between outer and inner liners 40 and 42, respectively. Domed inlet end 44 has a shape of a low area ratio diffuser.

Outer liner 40 and inner liner 42 are spaced radially inward from a combustor casing 46 and define a combustion chamber 48. Combustor casing 46 is generally annular and extends downstream from an exit 50 of a compressor, such as compressor 14 shown in FIG. 1. Combustion chamber 48 is generally annular in shape and is disposed radially inward from liners 40 and 42. Outer liner 40 and combustor casing 46 define an outer passageway 52 and inner liner 42 and combustor casing 46 define an inner passageway 54. Outer and inner liners 40 and 42, respectively, extend to a turbine inlet nozzle 58 disposed downstream from combustion chamber 48.

A first trapped vortex cavity 70 is incorporated into a portion 72 of outer liner 40 immediately downstream of dome inlet end 44 and a second trapped vortex cavity 74 is incorporated into a portion 76 of inner liner 42 immediately downstream of dome inlet end 44. In an alternative embodiment, combustor 30 includes only one trapped vortex cavity 70 or 74.

Trapped vortex cavity 70 is substantially similar to trapped vortex cavity 74 and each has a rectangular cross-sectional profile. In alternative embodiments, each vortex cavity 70 and 74 has a non-rectangular cross-sectional profile. In another embodiment, each vortex cavity 70 and 74 is sized differently such that each cavity 70 and 74 has a different volume. Furthermore, because each trapped vortex cavity 70 and 74 opens into combustion chamber 48, each vortex cavity 70 and 74 includes only an aft wall 80, an upstream wall 82, and a sidewall 84 extending between aft wall 80 and upstream wall 82. Each sidewall 84 is substantially parallel to a respective liner wall 40 and 42, and each is radially outward a distance 86 from combustor liner walls 40 and 42. A corner bracket 88 extends between trapped vortex cavity aft wall 80 and combustor liner walls 40 and 42 to secure each aft wall 80 to combustor liners 40 and 42. Trapped vortex cavity upstream wall 82, aft wall 80, and side wall 84 each include a plurality of passages (not shown) and openings (not shown) to permit air to enter each trapped vortex cavity 70 and 74.

Fuel is injected into trapped vortex cavities 70 and 74 and combustion chamber 48 through a plurality of fuel spray bar assemblies 90 that extend radially inward through combustor casing 46 upstream from a combustion chamber upstream wall 92 defining combustion chamber 48. Each fuel spray bar assembly 90, described in more detail below, includes a fuel spray bar 94 and a heat shield 96. Fuel spray bar 94 is secured in position relative to heat shield 96 with a plurality of caps 98. Caps 98 are attached to a top side 100 and a bottom side 102 of each fuel spray bar assembly 90.

Each fuel spray bar assembly 90 is secured within combustor 30 with a plurality of ferrules 110. Combustor chamber upstream wall 92 is substantially planar and includes a plurality of openings 112 to permit fuel and air to be injected into combustion chamber 48. Ferrules 110 extend from combustor chamber upstream wall 92 adjacent openings 112 and provide an interface between combustor 30 and spray bar assembly 90 that permits combustor 30 to thermally expand relative to spray bar assembly heat shield 96 without fuel leakage or excessive mechanical loading occurring as a result of thermal expansion. In one embodiment, structural ribs are attached to combustor 30 between adjacent fuel spray bar assemblies 90 to provide additional support to combustor 30.

A fuel delivery system 120 supplies fuel to combustor 30 and includes a pilot fuel circuit 122 and a main fuel circuit 124. Fuel spray bar assembly 90 includes pilot fuel circuit 122 and main fuel circuit 124. Pilot fuel circuit 122 supplies fuel to trapped vortex cavities 70 and 74 through fuel spray bar assembly 90 and main fuel circuit 124 supplies fuel to combustion chamber 48 through fuel spray bar assembly 90. Main fuel circuit 124 is radially inward from pilot fuel circuit 122. Fuel delivery system 120 also includes a pilot fuel stage and a main fuel stage used to control nitrous oxide emissions generated within combustor 30.

During operation, fuel is injected into combustor 30 through fuel spray bar assembly 90 using the pilot and main fuel stages. Fuel spray bar assembly 90 supplies fuel to trapped vortex cavities 70 and 74, and combustion chamber 48 through fuel spray bar assembly pilot and main fuel circuits 122 and 124, respectively. As fuel is ignited and burned within combustor 30, because combustor 30 is exposed to higher temperatures than fuel spray bar assembly 90, combustor 30 may thermally expand with a larger rate of expansion than fuel spray bar assembly 90. Ferrules 110 permit combustor 30 to thermally expand relative to fuel spray bar assembly heat shield 96 without fuel leakage or excessive mechanical loading occurring as a result of thermal expansion. Specifically, ferrules 110 permit combustor 30 to radially expand relative to spray bar assembly heat shield 96.

Figure 3:
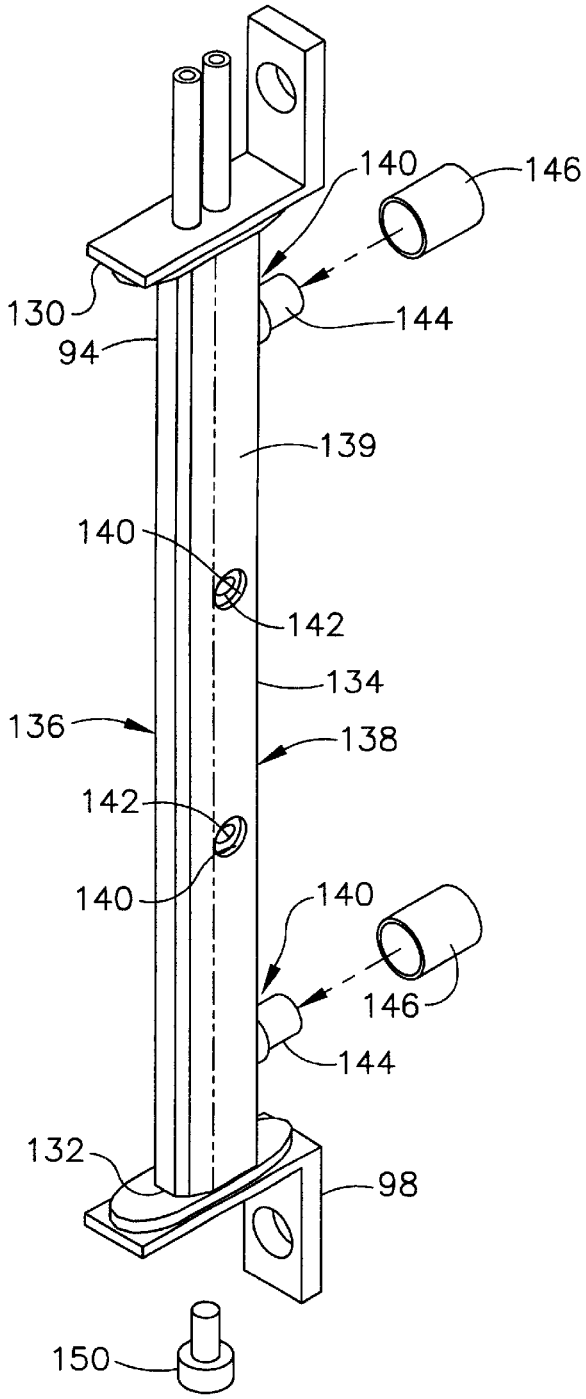
FIG. 3 is perspective view of a spray bar used with the combustor shown in FIG. 2.

FIG. 3 is perspective view of spray bar 94 used with fuel spray bar assembly 90 shown in FIG. 2. Spray bar 94 includes a top side 130, a bottom side 132, and a body 134 extending therebetween. Body 134 includes an upstream end 136, a downstream end 138, a first sidewall 139, and a second sidewall (not shown in FIG. 3). First sidewall 139 and the second sidewall are identical and extend between upstream and downstream ends 136 and 138, respectively. Upstream end 136 is aerodynamically-shaped and downstream end 138 is a bluff surface. In one embodiment, upstream end 136 is substantially elliptical and downstream end 138 is substantially planar.

A plurality of circular openings 140 extend into spray bar body 134 and are in flow communication with fuel delivery system 120. Specifically, a plurality of first openings 142 extend into first sidewall 139 and the second sidewall, and a plurality of second openings (not shown in FIG. 3) extend into downstream end 138. First openings 142 are in flow communication with main fuel circuit 124 and are known as main fuel tips. In one embodiment, spray bar body 134 includes two first openings 142 extending into both first sidewall 139 and the second sidewall.

The second openings are in flow communication with pilot fuel circuit 122 and are known as pilot fuel tips. In one embodiment, spray bar body 134 includes two second openings extending into spray bar downstream end 138. The second openings are radially outward from first openings 142 such that each second opening is between a spray bar top or bottom side 130 and 132, respectively, and a respective first opening 142.

An extension pipe 144 extends from each second opening radially outward and downstream. Extension pipes 144 are substantially cylindrical and each extends substantially perpendicularly from spray bar downstream end 138 towards combustion chamber 48. Each extension pipe 144 is sized to receive a pilot tip heat shield 146. Pilot tip heat shields 146 are attached circumferentially around each extension pipe 144 to provide thermal protection for extension pipes 144.

Caps 98 are attached to a top side 100 and a bottom side 102 of each fuel spray bar assembly 90. Specifically, caps 98 are attached to spray bar top side 130 and spray bar bottom side 132 with a fastener 150 and secure spray bar 94 in position relative to heat shield 96 (shown in FIG. 2). In one embodiment, fasteners 150 are bolts. In a second embodiment, fasteners 150 are pins. In an alternative embodiment, fasteners 150 are any shaped insert that secures cap 150 to spray bar 94. In a further embodiment, caps 98 are brazed to spray bar 94.

Figure 4:
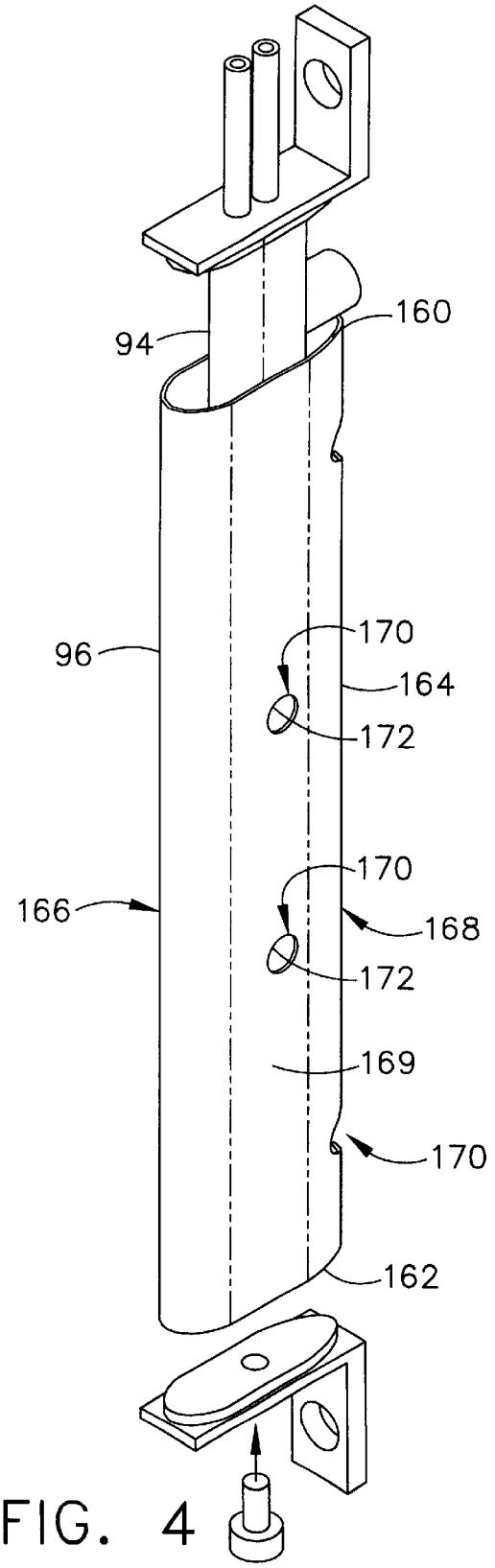
FIG. 4 is a perspective view of the spray bar shown in FIG. 4 including a heat shield.

FIG. 4 is a perspective view of spray bar 94 partially installed within heat shield 96. Heat shield 96 includes a top side 160, a bottom side 162, and a body 164 extending therebetween. Body 164 includes an upstream end 166, a downstream end 168, a first sidewall 169, and a second sidewall (not shown in FIG. 4). First sidewall 169 and the second sidewall are identical and extend between upstream and downstream ends 166 and 168, respectively. Upstream end 166 is aerodynamically-shaped and downstream end 168 is also aerodynamically-shaped. In one embodiment, upstream and downstream ends 166 and 168, respectively, are substantially elliptical.

Heat shield body 164 defines a cavity (not shown in FIG. 4) sized to receive spray bar 94 (shown in FIG. 3). A plurality of openings 170 extend into heat shield body 164 and are in flow communication with fuel delivery system 120. Specifically, a plurality of circular first openings 172 extend into heat shield first sidewall 169 and the heat shield second sidewall, and a plurality of second openings (not shown in FIG. 3) extend into downstream end 168. Heat shield first openings 162 are in flow communication with main fuel circuit 124 and spray bar first openings 172. In one embodiment, heat shield body 164 includes two first openings 172 extending into both first sidewall 169 and the second sidewall.

The heat shield second openings are in flow communication with pilot fuel circuit 122 and the spray bar second openings. In one embodiment, heat shield body 164 includes two second openings that extend into heat shield downstream end 168. The second openings are notch-shaped and sized to receive pilot tip heat shields 146 (shown in FIG. 3). The second openings are radially outward from heat shield first openings 172 such that each heat shield second opening is between heat shield top or bottom sides 160 and 162, respectively, and a respective first opening 172.

Figure 5:
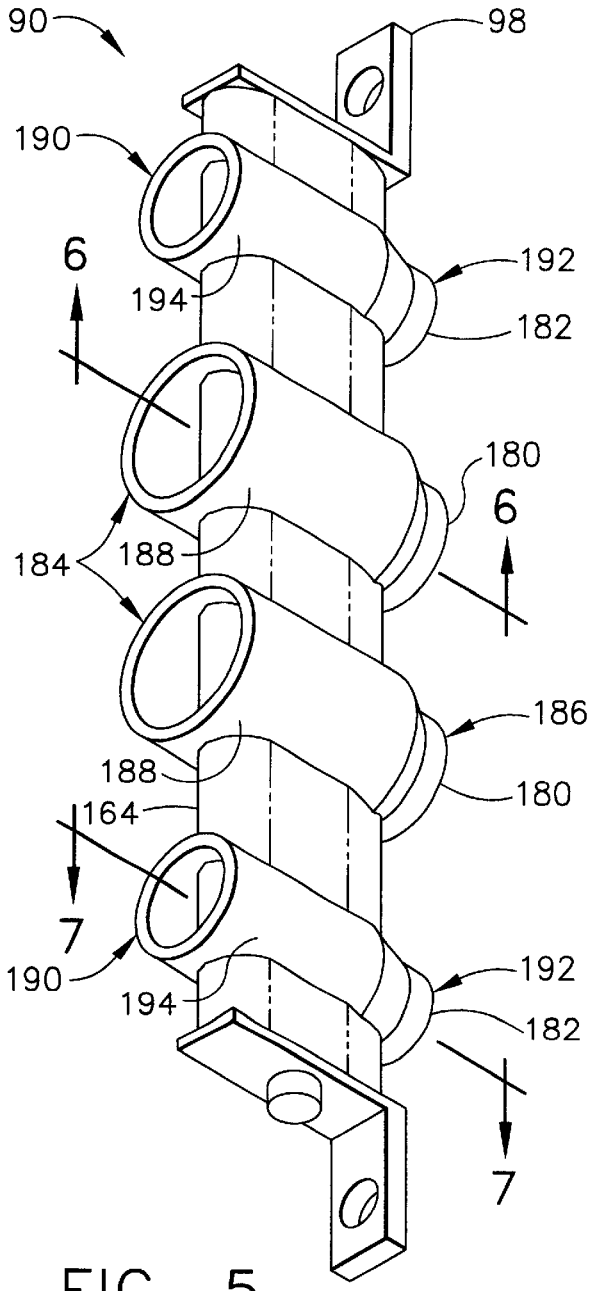
FIG. 5 is a perspective view of an assembled spray bar assembly used with the combustor shown in FIG. 2.

FIG. 5 is a perspective view of an assembled spray bar assembly 90 including a plurality of main injector tubes 180 and a plurality of pilot injector tubes 182 that direct air to main fuel tips 142 (shown in FIG. 3) and the pilot fuel tips (not shown in FIG. 5), respectively. Main and pilot injector tubes 180 and 182 attached radially outward of heat shield body 164. Main injector tubes 180 include an inlet side 184, an outlet side 186, and a hollow body 188 extending between inlet side 184 and outlet side 186. Hollow body 188 has a circular cross-sectional profile and inlet side 184 is sized to meter an amount of air entering hollow body 188 to mix with fuel injected through main fuel circuit 124.

Main injector tubes 180, described in more detail below, are attached to heat shield body 164 such that main injector inlet side 184 is upstream from heat shield upstream end 166 and main injector outlet side 186 extends downstream from heat shield downstream end 168. Main injector tubes 180 are also attached to heat shield body 164 in flow communication with heat shield first openings 162 and main fuel circuit 124 (shown in FIG. 2).

Pilot injector tubes 182, described in more detail below, include an inlet side 190, an outlet side 192, and a hollow body 194 extending between inlet side 190 and outlet side 192. Hollow body 194 has a circular cross-sectional profile and inlet side 192 is sized to meter an amount of air entering hollow body 194 to mix with fuel being injected through pilot fuel circuit 122. Pilot injector tubes 182 attached to heat shield body 164 such that pilot injector inlet side 190 is upstream from heat shield upstream end 166 and main injector outlet side 192 extends from pilot injector body 194 downstream from heat shield downstream end 168. Pilot injector tubes 182 are also attached to he a t shield body 164 in flow communication with the heat shield second openings and pilot fuel circuit 122 (shown in FIG. 2).

During assembly of combustor 30, fuel spray bar assembly 90 is initially assembled. Spray bar 94 (shown in FIG. 3) is initially inserted within the heat shield cavity such that spray bar upstream side 136 is adjacent shield upstream end 166 to permit spray bar pilot extension pipes 144 to fit within the heat shield cavity during installation. Spray bar 94 is then re-positioned axially aftward such that pilot tip extension pipes 144 are received within the heat shield second openings. Caps 98 are then attached to spray bar 90 to position spray bar 90 relative to heat shield 96 such that heat shield first openings 172 (shown in FIG. 4) remain in flow communication with spray bar first openings 172 and the heat shield second openings (not shown in FIG. 5) remain in flow communication with the spray bar second openings (not shown in FIG. 5).

Main and pilot injector tubes 180 and 182, respectively, are attached to heat shield 96 in flow communication with heat shield first openings 172 and the heat shield second openings, respectively. Each fuel spray bar assembly 90 is attached within combustor 30.

Figure 6:
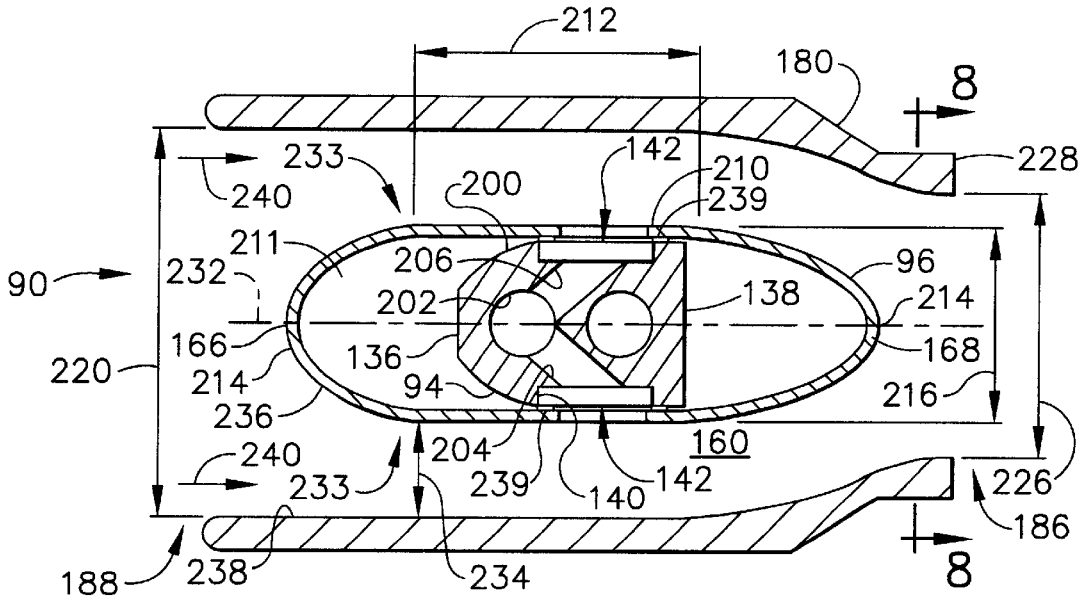
FIG. 6 is a cross-sectional view of the fuel spray bar assembly shown in FIG. 5 taken along line 6—6.

FIG. 6 is a cross-sectional view of fuel spray bar assembly 90 taken along line 6—6 shown in FIG. 5 and including spray bar 94, heat shield 96, and main injector tube 180. Spray bar body 134 includes a second sidewall 200 is substantially parallel to spray bar body first sidewall 139 and extends between spray bar upstream and downstream ends 136 and 138, respectively. First and second sidewalls 139 and 200, respectively, include openings 142 to permit main fuel circuit 124 to inject fuel to combustor 30.

Main fuel circuit 124 includes a main supply tube 202 that extends from spray bar top side 130 (shown in FIG. 3) towards spray bar bottom side 132 (shown in FIG. 3). A pair of secondary tubes 204 and 206 attach in flow communication to direct fuel from supply tube 202 radially outward from openings 142.

Heat shield body 164 includes a second sidewall 210 that is substantially parallel to heat shield first sidewall 169 and extends between heat shield upstream and downstream ends 166 and 168, respectively. Sidewalls 169 and 210, and upstream and downstream ends 166 and 168 connect to define a cavity 211 sized to receive spray bar 94.

Upstream and downstream ends 166 and 168, respectively, are constructed substantially similarly and each includes a length 212 extending between a sidewall 169 or 210 and an apex 214 of each end 166 or 168. Additionally, each end 166 and 168 includes a width 216 extending between sidewalls 169 and 210. To provide for adequate air and fuel flows through main injector tube 180, a length-to-width ratio of each end 166 and 168 is greater than approximately three.

Main injector tube 180 is attached to heat shield body 164 such that main injector inlet side 184 is upstream from heat shield upstream end 166 and main injector outlet side 186 extends downstream from heat shield downstream end 168. Main injector inlet side 184 has a first diameter 220 that is larger than heat shield width 216. Main injector diameter 220 is constant through a main injector body 188 to an approximate midpoint of heat shield 96. Main injector tube body 188 extends between main injector inlet side 184 and main injector outlet side 186.

Main injector outlet side 186 extends from main injector body 188 and gradually tapers such that a diameter 226 at a trailing edge 228 of main injector tube 180 is less than main injector inlet diameter 220. Because main injector outlet side 186 tapers towards an axis of symmetry 232 of fuel spray bar assembly 90, an air passageway 233 defined between heat shield 96 and main injector tube 180 has a width 234 extending between an outer surface 236 of heat shield 96 and an inner surface 238 of main injector tube 180 that remains substantially constant along heat shield sidewalls 169 and 210.

A ring step 239 prevents fuel from leaking into heat shield cavity 211 and centers spray bar 94 within cavity 211. In one embodiment, ring step 239 is formed integrally with spray bar 94. In another embodiment, ring step 239 is press fit within heat shield cavity 211. In yet another embodiment, main injector tube 180 does not include ring step 239. Because fuel is prevented from entering heat shield cavity 211, auto-ignition of fuel within heat shield cavity 211 is reduced.

During operation, main fuel circuit 124 injects fuel through spray bar openings 142 and heat shield openings 172 into air passageway 233. The combination of the length-to-width ratio of each heat shield end 166 and 168, and main injector tube 180 ensures that a greatest flow restriction, or a smallest cross-sectional area of air passageway 233 is upstream from fuel injection points or openings 172. In an alternative embodiment, a smallest cross-sectional area of air passageway is adjacent fuel injection openings 172. In a further alternative embodiment, a smallest cross-sectional area of air passageway is downstream from fuel injection openings 172. Because air passageway width 234 remains constant or slightly converges from openings 172 to main injector outlet side 186, airflow 240 entering main injector tube 180 remains at a constant velocity or slightly accelerates to prevent recirculation areas from forming downstream in a fuel injector wake as a fuel/air mixture exits main injector outlet side 186.

Figure 7:
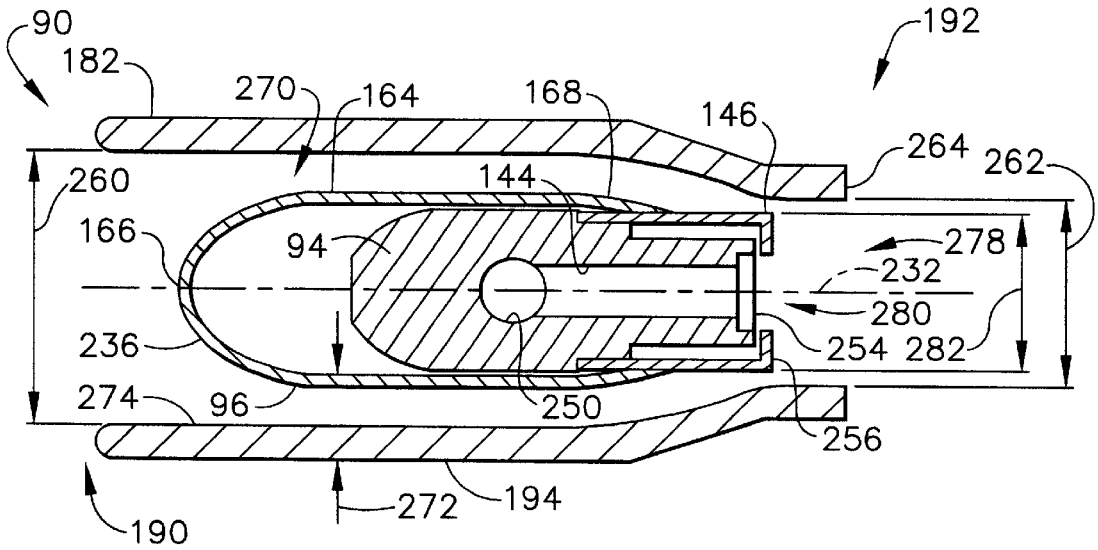
FIG. 7 is a cross-sectional view of the fuel spray bar assembly shown in FIG. 5 taken along line 7—7.

FIG. 7 is a cross-sectional view of fuel spray bar assembly 90 taken along line 7—7 shown in FIG. 5 and including spray bar 94, heat shield 96, and pilot injector tube 182. Pilot fuel circuit 122 includes a main supply tube 250 that extends from spray bar top side 130 (shown in FIG. 2) towards spray bar bottom side 132 (shown in FIG. 2) and outward through a pilot fuel tip 254 and extension pipe 144. Pilot tip heat shield 146 is attached circumferentially around each pilot extension pipe 144 and has a downstream end 256.

Pilot injector tube 182 is attached to heat shield body 164 such that pilot injector inlet side 190 is upstream from heat shield upstream end 166 and pilot injector outlet side 192 extends downstream from heat shield downstream end 168. Pilot injector inlet side 190 has a first diameter 260 that is larger than heat shield width 216. Pilot injector diameter 260 is constant through pilot injector body 194 to a midpoint 261 of heat shield 96.

Pilot injector outlet side 192 extends from pilot injector body 194 and gradually tapers such that a diameter 262 at a trailing edge 264 of pilot injector tube 182 is less than pilot injector inlet diameter 260. Because pilot injector outlet side 192 tapers towards fuel spray bar assembly axis of symmetry 232, an air passageway 270 defined between heat shield 96 and pilot injector tube 182 has a width 272 extending between heat shield outer surface 236 and an inner surface 274 of pilot injector tube 182.

Pilot injector tubes 182 also include a plurality of second openings 278 extending into spray bar body 134 and in flow communication with fuel delivery system 120. Second openings 278 are also in flow communication with a plurality of heat shield second openings 280. Extension pipe 144 extends from each second opening 278 and each pilot tip heat shield 146 is attached circumferentially around each extension pipe 144. Pilot injector outlet side diameter 262 is larger than a diameter 282 of each pilot tip heat shield 146. In one embodiment, pilot injector tubes 182 also include ring step 239 (shown in FIG. 6).

During operation, pilot fuel circuit 122 injects fuel through spray bar openings 278 and heat shield openings 280 into air passageway 270. Because air passageway width 272 remains constant around pilot injector tube 182, airflow 240 entering pilot injector tube 182 remains at a constant velocity to prevent recirculation areas from forming downstream in a fuel injector wake as a fuel/air mixture exits pilot injector outlet side 192. In an alternative embodiment, air passageway 270 slightly converges around pilot injector tube 182 and airflow entering pilot injector tube accelerates slightly to prevent recirculation areas from forming downstream in a fuel injector wake as a fuel/air mixture exits pilot injector outlet side 192.

Figure 8:
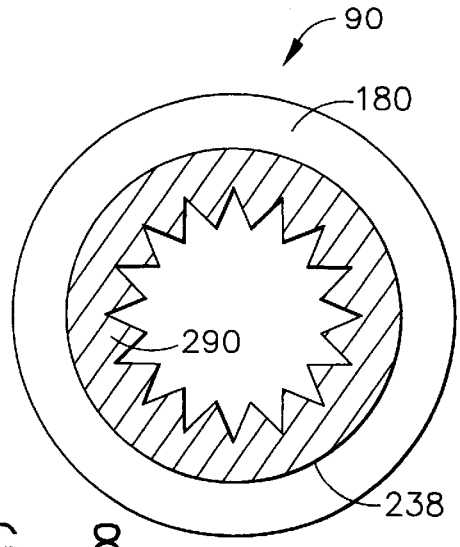
FIG. 8 is a cross-sectional view of the fuel spray bar assembly shown in FIG. 6 taken along line 8—8.

FIG. 8 is a cross-sectional view of fuel spray bar assembly 90 taken along line 8—8 shown in FIG. 6. Specifically, FIG. 8 is a cross-sectional view of main injector tube outlet side 186 (shown in FIG. 6). Main injector tube outlet side 186 includes a plurality of turbulators 290 extending radially inward from main injector tube inner surface 238 towards axis of symmetry 232 (shown in FIG. 6). In an alternative embodiment, main injector tube outlet side 186 does not include turbulators 290. Turbulators 290 provide a contoured surface that increases vortex generation as an air/fuel mixture exits each turbulator 290. The increased vortex generation increases a turbulence intensity and enhances mixing between fuel and air. As a result of enhanced mixing, combustion is improved.

During operation, as gas turbine engine 10 (shown in FIG. 1) is started and operated at idle operating conditions, fuel and air are supplied to combustor 16 (shown in FIG. 1). During gas turbine idle operating conditions, combustor 16 uses only the pilot fuel stage for operating. Pilot fuel circuit 122 (shown in FIG. 2) injects fuel to combustor trapped vortex cavity 70 through fuel spray bar assembly 90. Simultaneously, airflow enters trapped vortex cavity 70 through aft, upstream, and outer wall air passages and enters combustor 16 (shown in FIG. 1) through main injector tubes 180 (shown in FIG. 6). The trapped vortex cavity air passages form a collective sheet of air that mixes rapidly with the fuel injected and prevents the fuel from forming a boundary layer along aft wall 80 (shown in FIG. 2) or side wall 84 (shown in FIG. 2).

Combustion gases generated within trapped vortex cavity 70 swirl in a counter-clockwise motion and provide a continuous ignition and stabilization source for the fuel/air mixture entering combustion chamber 48. Airflow 240 entering combustion chamber 48 through main injector tubes 180 increases a rate of fuel/air mixing to enable substantially near-stoichiometric flame-zones (not shown) to propagate with short residence times within combustion chamber 48. As a result of the short residence times within combustion chamber 48, nitrous oxide emissions generated within combustion chamber 48 are reduced.

Utilizing only the pilot fuel stage permits combustor 30 to maintain low power operating efficiency and to control and minimize emissions exiting combustor 30 during engine low power operations. The pilot flame is a spray diffusion flame fueled entirely from gas turbine start conditions. As gas turbine engine 10 is accelerated from idle operating conditions to increased power operating conditions, additional fuel and air are directed into combustor 30. In addition to the pilot fuel stage, during increased power operating conditions, main fuel circuit 124 supplies fuel with the main fuel stage through fuel spray bar assembly 90 and main injector tubes 180.

During operation, because heat shield upstream and downstream ends 166 and 168, respectively, are aerodynamically-shaped, airflow passing around heat shield 96 (shown in FIG. 4) is prevented from recirculating towards fuel spray bar assembly 90. Because recirculation zones are prevented from forming, a risk of fuel leaking into heat shield cavity 211 (shown in FIG. 4) and auto-igniting is reduced. Furthermore, because injector tubes 180 and 182 are tapered, fuel and air are more thoroughly mixed prior to entering combustion zone 48. As a result, combustion is improved and peak flame temperatures are reduced, thus reducing an amount of nitrous oxide produced within combustor 30.

The above-described combustor is cost-effective and highly reliable. The combustor includes a fuel spray bar assembly that includes two fuel circuits and a spray bar within an aerodynamically shaped heat shield. During operation, the aerodynamic shape of the heat shield prevent s recirculation zones from forming. Furthermore, the fuel spray bar assembly enhances fuel and air mixing. As a result, combustion is enhanced, flame temperatures are reduced, and combustion is improved. Thus, the combustor with a high combustion efficiency and with low carbon monoxide, nitrous oxide, and smoke emissions.

While the invention has been described in terms of various specific embodiments, those skilled in the art will recognize that the invention can be practiced with modification within the spirit and scope of the claims.

What is claimed is:

1. A fuel spray bar assembly for a gas turbine engine combustor, said fuel spray bar comprising:

a spray bar comprising an upstream side, a downstream side, and a plurality of injectors configured to supply fuel to the combustor, at least one of said injectors extending substantially perpendicularly from said spray bar downstream side; and a heat shield comprising an upstream side, a downstream side, and a pair of sidewalls extending therebetween, said upstream side and said downstream side aerodynamically-shaped, said spray bar upstream from said heat shield downstream side such that at least one of said plurality of injectors configured to inject fuel through said heat shield in a downstream direction from said heat shield.

2. A fuel spray bar assembly in accordance with claim 1 wherein said heat shield upstream side, said downstream side, and said sidewalls connected to define a cavity sized to receive said spray bar.

3. A fuel spray bar assembly in accordance with claim 1 wherein said spray bar further comprises a plurality of fuel circuits.

4. A fuel spray bar assembly in accordance with claim 1 wherein said spray bar further comprises a top and a bottom, said fuel spray bar assembly further comprises at least two caps configured to secure said fuel spray bar assembly within said combustor, a first of said caps attached to said spray bar top, a second of said caps attached to said spray bar bottom.

5. A fuel spray bar assembly in accordance with claim 1 wherein said fuel spray bar assembly further comprises a ring step between said spray bar and said heat shield.

6. A fuel spray bar assembly in accordance with claim 5 wherein said ring step configured to prevent fuel leakage into said spray bar cavity.

7. A fuel spray bar assembly in accordance with claim 1 wherein said fuel spray bar assembly further comprises a plurality of injector tubes radially outward from said heat shield.

* * * * *